US010190427B2

(12) United States Patent
Kang et al.

(10) Patent No.: US 10,190,427 B2
(45) Date of Patent: Jan. 29, 2019

(54) TURBINE NOZZLE BOX

(71) Applicant: DOOSAN HEAVY INDUSTRIES & CONSTRUCTION CO., LTD., Gyeongsangnam-do (KR)

(72) Inventors: Dong Woo Kang, Gyeonggi-do (KR); Hae Sang Jeong, Gyeonggi-do (KR); Cheol Hong Kim, Gyeonggi-do (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 370 days.

(21) Appl. No.: 15/085,998

(22) Filed: Mar. 30, 2016

(65) Prior Publication Data

US 2016/0290148 A1 Oct. 6, 2016

(30) Foreign Application Priority Data

Apr. 6, 2015 (KR) ..... 10-2015-0048360

(51) Int. Cl.
*F01D 9/04* (2006.01)
*F01D 25/28* (2006.01)
(Continued)

(52) U.S. Cl.
CPC ..... *F01D 9/047* (2013.01); *F01D 9/02* (2013.01); *F01D 9/04* (2013.01); *F01D 17/18* (2013.01);
(Continued)

(58) Field of Classification Search
CPC ... F01D 9/047; F01D 9/02; F01D 9/04; F01D 17/18; F01D 25/246; F01D 25/28;
(Continued)

(56) References Cited

U.S. PATENT DOCUMENTS 2,631,005 A * 3/1953 English ..... F01D 9/047 415/189
2,651,495 A * 9/1953 Corbett ..... F01D 9/047 415/139
(Continued)

FOREIGN PATENT DOCUMENTS

CN 102454430 5/2012
EP 2837770 A1 2/2015
(Continued)

OTHER PUBLICATIONS

An extended European search report issued by the European Patent Office dated Sep. 22, 2016 in connection with European patent application No. 16164013.1.
(Continued)

*Primary Examiner* — Logan Kraft
*Assistant Examiner* — Eric Zamora Alvarez
(74) *Attorney, Agent, or Firm* — Invenstone Patent, LLC

(57) ABSTRACT

A turbine nozzle box includes an annular outer ring plate, an annular nozzle unit, and an annular inner ring plate. The annular outer ring plate is operable to be disposed in a turbine such that an outer peripheral surface thereof is adjacent to an inner peripheral surface of an inner casing of the turbine. The annular nozzle unit is disposed adjacent to an inner peripheral surface of the outer ring plate. The annular inner ring plate is disposed such that an outer peripheral surface thereof is adjacent to an inner peripheral surface of the nozzle unit. The nozzle unit includes a plurality of segment blocks circumferentially installed at an arc angle. The segment blocks are disposed at an inlet end of a first-stage nozzle unit, and an outlet end of the first-stage nozzle unit is open.

11 Claims, 7 Drawing Sheets

(51) Int. Cl.
*F01D 17/18* (2006.01)
*F01D 9/02* (2006.01)
*F01D 25/24* (2006.01)

(52) U.S. Cl.
CPC ..... *F01D 25/246* (2013.01); *F01D 25/28* (2013.01); *F05D 2220/30* (2013.01); *F05D 2240/128* (2013.01); *F05D 2260/30* (2013.01)

(58) Field of Classification Search
CPC ..... F01D 17/141; F01D 17/43; F01D 17/145; F01D 17/16; F01D 17/162; F01D 17/167; F05D 2220/30; F05D 2240/128; F05D 2260/30
See application file for complete search history.

(56) References Cited

U.S. PATENT DOCUMENTS 4,036,020 A * 7/1977 Bagley ..... F01D 9/02 239/135
5,807,074 A * 9/1998 Fournier ..... F01D 9/041 415/209.3
6,631,858 B1 * 10/2003 Farineau ..... F01D 9/02 239/548
6,964,554 B2 * 11/2005 Groenendaal ..... F01D 9/041 415/136
2003/0103845 A1 6/2003 Hamlin et al.
2014/0105720 A1 * 4/2014 Bindingnavale Ranga ..... F01D 17/162 415/1
2015/0050134 A1 * 2/2015 Shurrock ..... F01D 9/02 415/191

FOREIGN PATENT DOCUMENTS

JP 45-003561 B 2/1970
JP 59-66948 A 4/1984
JP 04-044404 U1 4/1992
JP 2524778 2/1997
JP 2009108855 A 5/2009
JP 2012-233479 A 11/2012
KR 1020070028254 3/2007

OTHER PUBLICATIONS

Japanese Office Action issued by the Japanese Patent Office dated Aug. 15, 2017 in connection with Japanese patent application No. 2016-069538.
Office Action issued in corresponding Japanese Application No. 2016-069538, dated Dec. 27, 2016, 4 pages.

* cited by examiner

TURBINE NOZZLE BOX

CROSS-REFERENCE(S) TO RELATED APPLICATIONS

This application claims priority to Korean Patent Application No. 10-2015-0048360 filed on Apr. 6, 2015 the disclosure of which is incorporated herein by reference in its entirety.

BACKGROUND

Exemplary embodiments of the present disclosure relate to a turbine nozzle box.

A large axial-flow steam turbine generally includes turbine nozzles (turbine fixed blades) which are referred to as stators, and blades (turbine moving blades) which are referred to as rotors. In addition, the turbine nozzles and turbine moving blades are installed in a multistage manner in the flow direction of steam (fluid).

An impulse steam turbine allows the thermal energy of steam to perform more expansion work using each turbine nozzle, and switches the flow of steam into a deflecting flow using each turbine moving blade after the expansion work is finished so as to guide the deflecting flow to a next stage.

A conventional turbine nozzle box typically includes a plurality of parts, and the parts are coupled using bolts or by welding.

After the steam in the turbine nozzle box is first redirected so as to axially flow, it is accelerated about the rotary axis of a rotor through nozzles located on the outlet plane of the nozzle box.

A partial arc operation refers to an operation for supplying steam to only a partial region of the quadrant of the turbine, and may be performed for electricity generation capacity if necessary.

However, the region of the turbine is uniformly divided into many sections during the conventional partial arc operation, and gas may not be introduced into a partial section due to the full blocking of passages for the region division, thereby leading to formation of a dead arc zone in which the partial section is not used.

In addition, the efficiency of the turbine may be reduced during the partial arc operation due to the formation of the dead arc zone.

BRIEF SUMMARY

A turbine nozzle box includes an annular outer ring plate, an annular nozzle unit, and an annular inner ring plate. The annular outer ring plate is operable to be disposed in a turbine such that an outer peripheral surface thereof is adjacent to an inner peripheral surface of an inner casing of the turbine. The annular nozzle unit is disposed adjacent to an inner peripheral surface of the outer ring plate. The annular inner ring plate is disposed such that an outer peripheral surface thereof is adjacent to an inner peripheral surface of the nozzle unit. The nozzle unit includes a plurality of segment blocks circumferentially installed at an arc angle. The segment blocks are disposed at an inlet end of a first-stage nozzle unit, and an outlet end of the first-stage nozzle unit is open.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
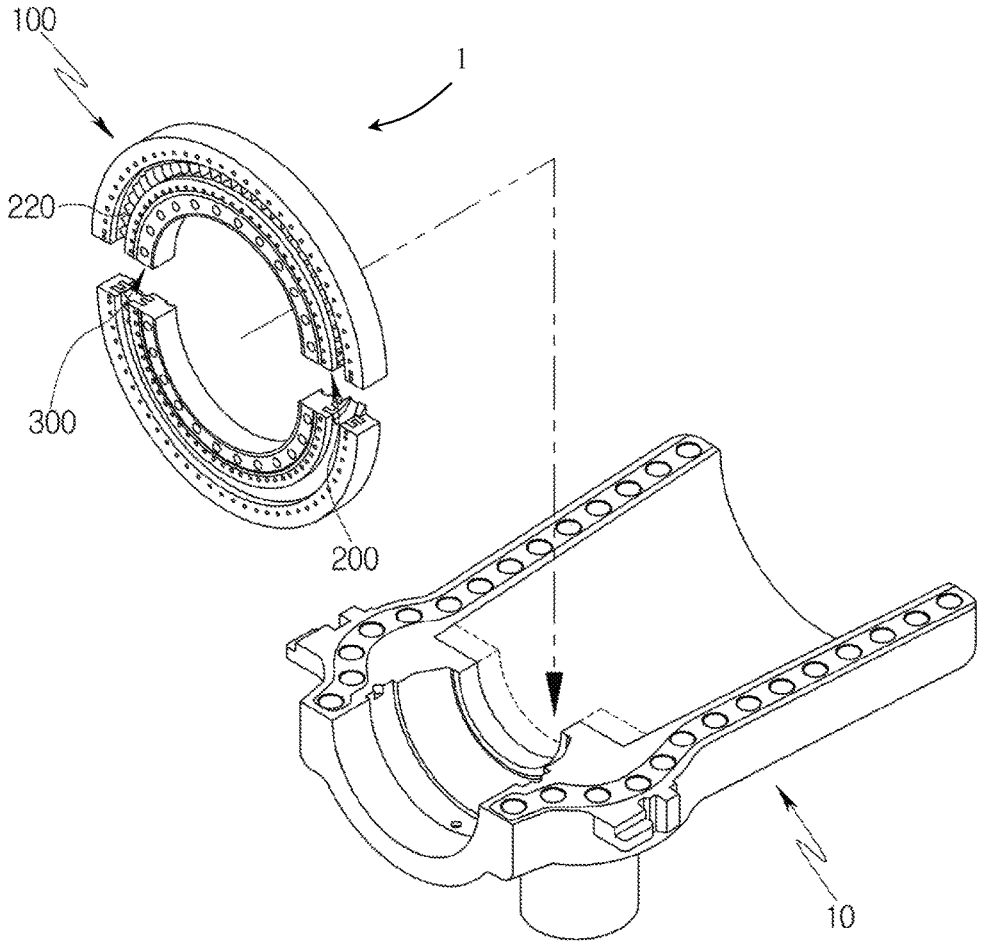
FIG. 1 is a perspective view illustrating a state in which a turbine nozzle box according to an embodiment of the present disclosure is installed in an inner casing of a high-pressure turbine.

An object of the present disclosure is to provide a turbine nozzle box installed in a first stage of a high-pressure turbine in order to improve overall efficiency of the turbine by circumferentially installing four segment blocks by an arc angle of 90 degrees at an inlet end of a nozzle unit so that the inlet end is divided into four portions for a partial arc operation, and by performing an overall arc operation in an outlet end of the nozzle unit so as to reduce formation of a dead arc zone.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an aspect of the present disclosure, a turbine nozzle box, installed in a first stage of a high-pressure turbine for a partial arc operation in the first stage of the high-pressure turbine, includes an annular outer ring plate installed such that an outer peripheral surface thereof is adjacent to an inner peripheral surface of an inner casing, an annular nozzle unit installed adjacent to an inner peripheral surface of the outer ring plate, and an annular inner ring plate installed such that an outer peripheral surface thereof is adjacent to an inner peripheral surface of the nozzle unit, wherein the nozzle unit includes a plurality of segment blocks circumferentially installed at a predetermined arc angle, and the segment blocks are installed at an inlet end of a first-stage nozzle unit, and an outlet end of the first-stage nozzle unit is opened.

Each of the outer ring plate, the nozzle unit, and the inner ring plate may be divided into two upper and lower portions, each having a semicircular shape.

Each front surfaces of the segment blocks may be located in a state in which an overall surface of the nozzle box is closed in order to block movement of fluid introduced between the outer ring plate and the inner ring plate, and each rear surface of the segment blocks may be maintained in an opened state in order to move fluid introduced through the nozzle unit disposed adjacent thereto.

The segment blocks may be four segment blocks circumferentially installed at the inlet end of the first-stage nozzle unit.

The segment blocks may be circumferentially arranged by an arc angle of 90 degrees so that the inlet end of the first-stage nozzle unit is divided into four portions.

Each of the segment blocks may include a nozzle frame configured to close a gap between the outer ring plate and the inner ring plate on a front surface of the nozzle box, a nozzle located at an inner center of the nozzle frame while extending in a streamlined form toward the outlet end of the nozzle box, extension parts extending outward from the nozzle, and an insertion hole opened in each of the extension parts.

The extension parts may be formed with coupling portions, and corresponding surfaces of the outer and inner ring plates facing the respective coupling portions may have a shape corresponding to the coupling portions.

A passage may be provided such that fluid is movable outward from the nozzle formed in the segment block.

The passage may be narrowed toward a trailing edge of the nozzle from a leading edge thereof.

The nozzle unit may include a plurality of nozzles circumferentially arranged at regular intervals.

The nozzle unit may be configured such that an introduction portion formed on a front surface of each of the nozzles has a relatively larger area than a discharge portion formed on a rear surface thereof.

Each of the segment blocks may be formed integrally with an associated one of nozzles arranged by an arc angle of 90 degrees in the outlet end of the first-stage nozzle unit.

Each of the segment blocks and an associated one of nozzles arranged by an arc angle of 90 degrees in the outlet end of the first-stage nozzle unit may be coupled to each other by a pin in the inner casing.

It is to be understood that both the foregoing general description and the following detailed description of the present disclosure are exemplary and explanatory and are intended to provide further explanation of the invention as claimed.

Exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Figure 2:
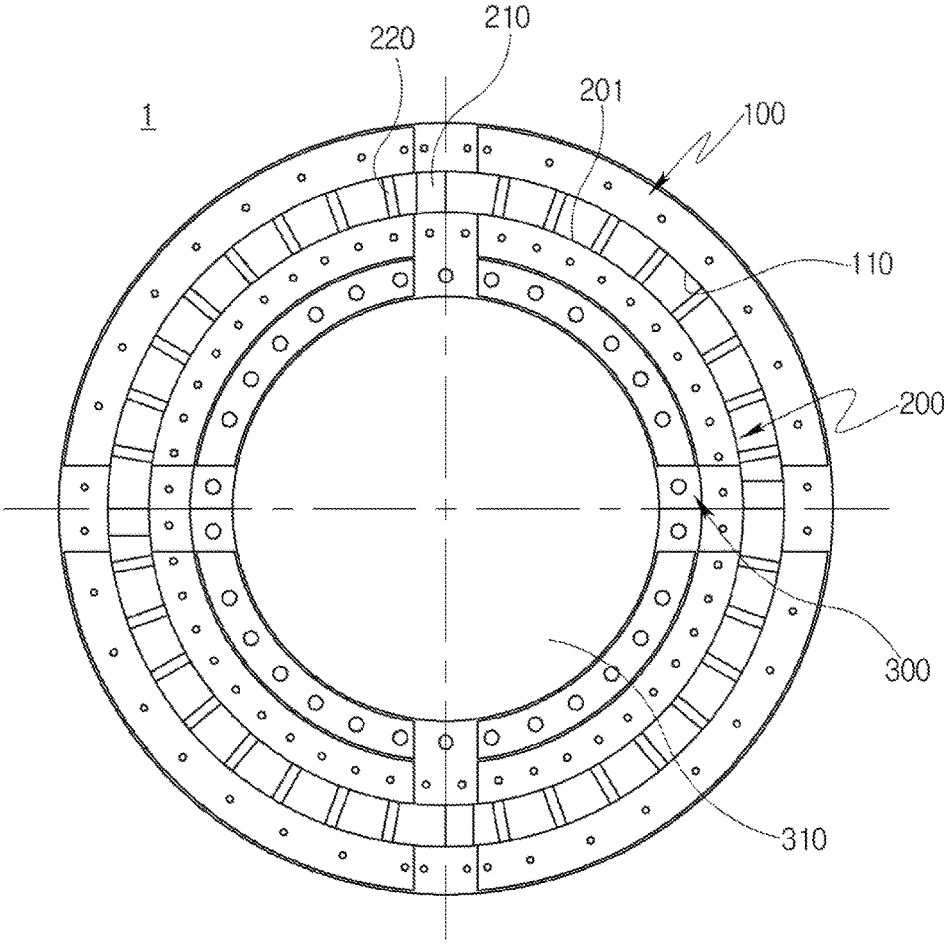
FIG. 2 is a front view illustrating the turbine nozzle box according to the embodiment of the present disclosure.
Figure 3:
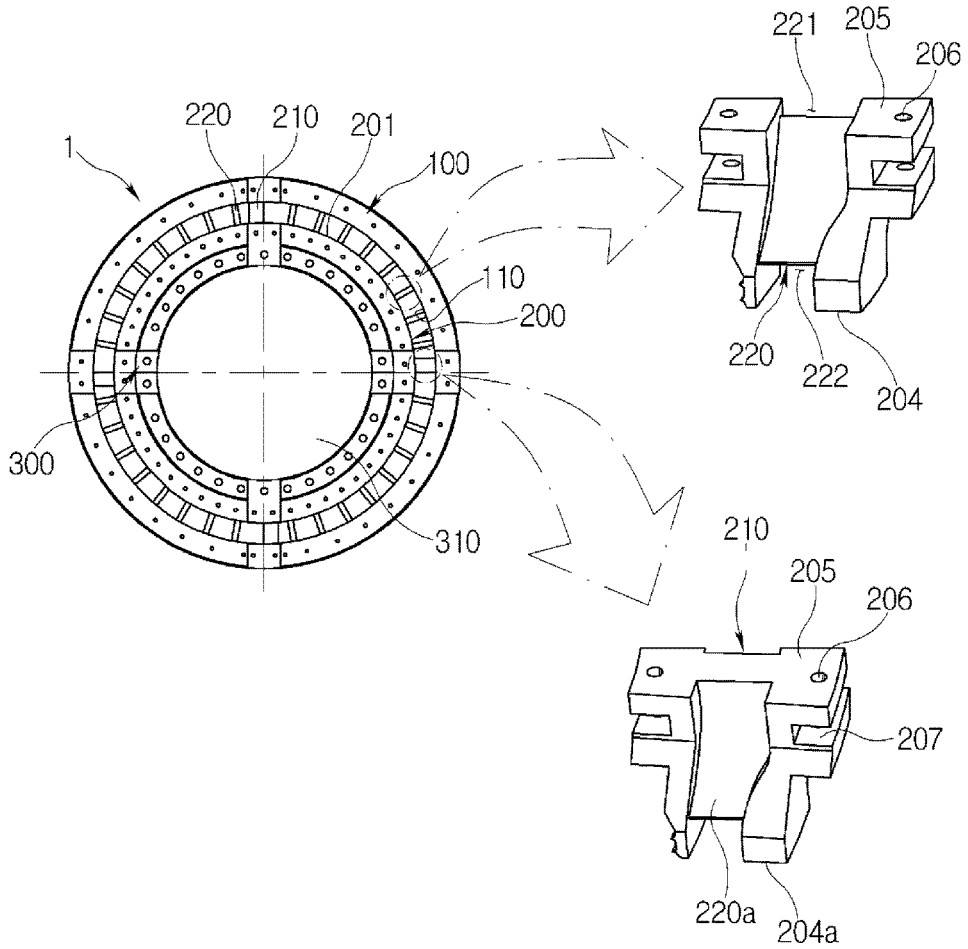
FIG. 3 is a view illustrating segment blocks and nozzles provided in a nozzle unit according to the embodiment of the present disclosure.
Figure 4:
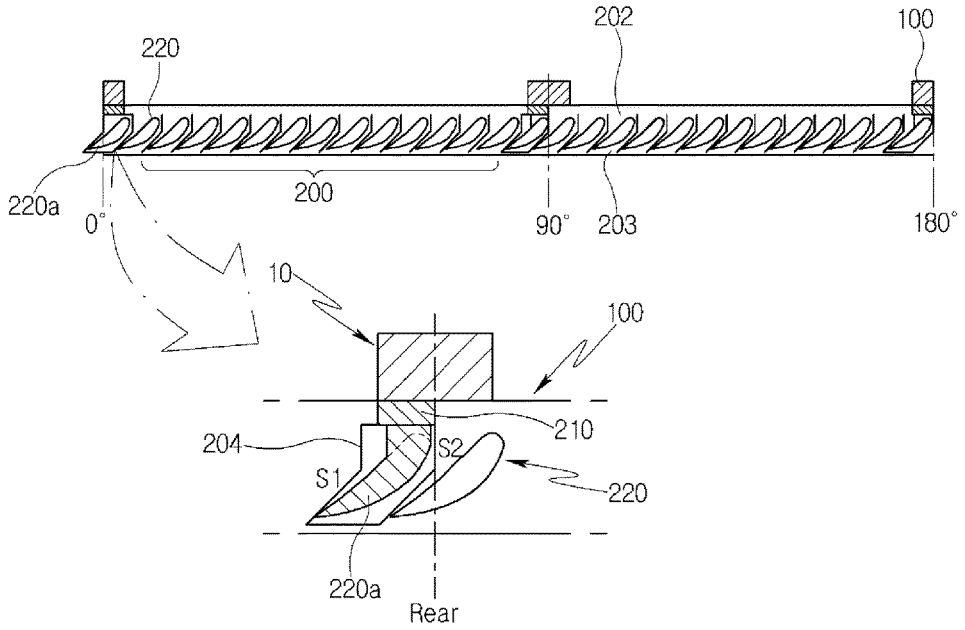
FIG. 4 is a view illustrating a state in which one side of the turbine nozzle box according to the embodiment of the present disclosure is spread out.

FIG. 1 is a perspective view illustrating a state in which a turbine nozzle box according to an embodiment of the present disclosure is installed in an inner casing of a high-pressure turbine. FIG. 2 is a front view illustrating the turbine nozzle box according to the embodiment of the present disclosure. FIG. 3 is a view illustrating segment blocks and nozzles provided in a nozzle unit according to the embodiment of the present disclosure. FIG. 4 is a view illustrating a state in which one side of the turbine nozzle box according to the embodiment of the present disclosure is spread out.

The nozzle box, which is designated by reference numeral 1, according the embodiment of the present disclosure will be described with reference to FIGS. 1 and 2.

The nozzle box 1 according the embodiment of the present disclosure is installed to a first stage of a plurality of first to nth stages constituting a high-pressure turbine, and serves to guide the flow of fluid. The turbine nozzle box 1 according the embodiment of the present disclosure includes an outer ring plate 100, a nozzle unit 200, and an inner ring plate 300.

The outer ring plate 100 is divided into upper and lower portions which each have a semicircular shape, and forms a ring when the upper and lower portions are assembled to each other. The outer ring plate 100 is installed such that the outer peripheral surface thereof is adjacent to the inner peripheral surface of an inner casing 10 which will be described later. That is, the outer ring plate 100 is installed such that the outer peripheral surface thereof comes into contact with the inner peripheral surface of the inner casing 10. The outer ring plate 100 has a shape corresponding to the inner peripheral surface of the inner casing 10, but the present disclosure is not necessarily limited thereto. For example, the outer ring plate 100 may have an annular ring shape.

The nozzle unit 200 is installed such that the outer peripheral surface 201 thereof is adjacent to the inner peripheral surface 110 of the outer ring plate 100. That is, the nozzle unit 200 is installed such that the outer peripheral surface 201 thereof comes into contact with the inner peripheral surface 110 of the outer ring plate 100. In addition, the nozzle unit 200 has an annular ring shape similar to the inner peripheral surface 110 of the outer ring plate 100.

The inner ring plate 300 is installed such that the outer peripheral surface thereof is adjacent to the inner peripheral surface of the nozzle unit 200. That is, the inner ring plate 300 is installed such that the outer peripheral surface thereof comes into contact with the inner peripheral surface of the nozzle unit 200.

The outer ring plate 100, the nozzle unit 200, and the inner ring plate 300 may be separately manufactured so as to be coupled using a fastener such as bolts or rivets, or by welding, but the present disclosure is not necessarily limited thereto.

Each of the outer ring plate 100, the nozzle unit 200, and the inner ring plate 300 may be divided into two upper and lower portions which each have a semicircular shape, and the semicircular upper and lower outer ring plates, nozzle units, and inner ring plates may be separately manufactured and coupled to each other.

The turbine nozzle box may be installed in the first-stage inner casing of the high-pressure turbine by a fastener such as bolts or rivets.

In addition, as illustrated in FIG. 2, the inner ring plate 300 has a cavity portion 310 formed at the center thereof, and rotors (not shown) may be installed in the cavity portion 310.

The nozzle unit 200 has a plurality of segment blocks 210 which are circumferentially installed at a predetermined arc angle between the outer ring plate 100 and the nozzle unit 200.

Figure 5:
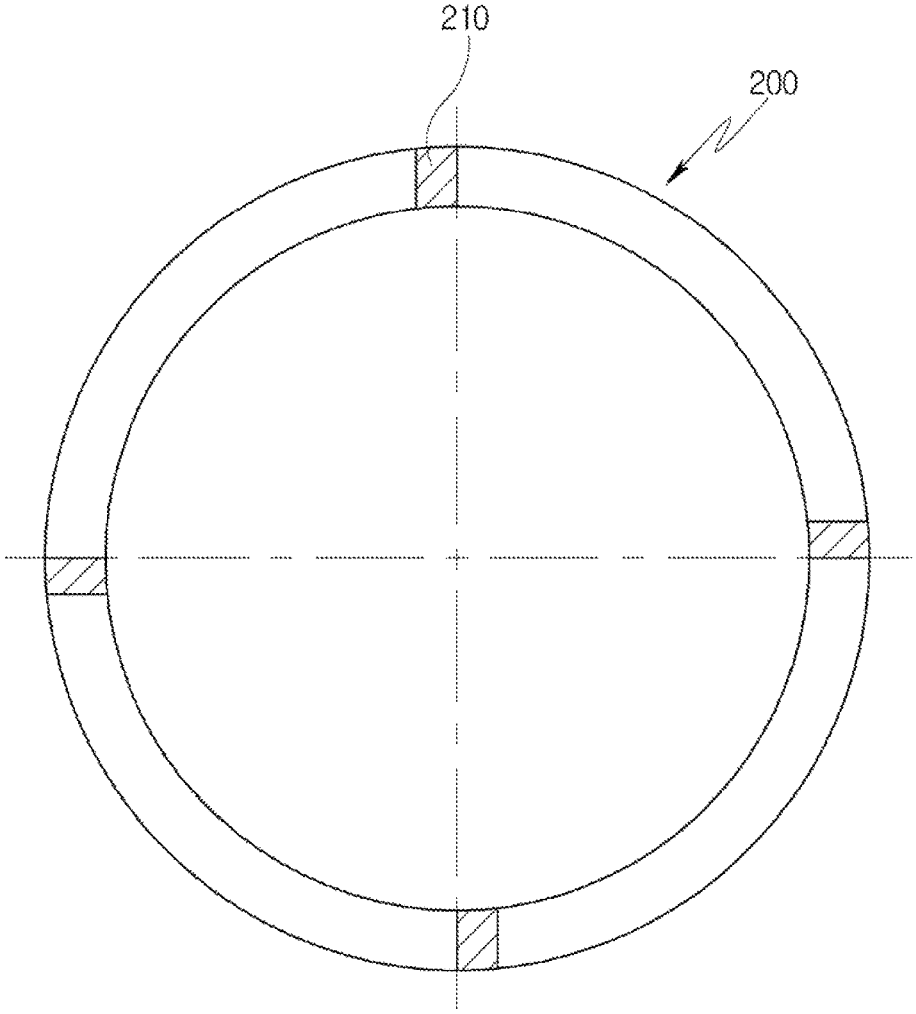
FIG. 5 is a view schematically illustrating the turbine nozzle box according to the embodiment of the present disclosure when viewed from the inlet end thereof.

Referring to FIGS. 3 to 5, the segment blocks 210 according to the embodiment of the present disclosure are respectively disposed at an angular position of 0 degrees (at a 12-o'clock position in the clockwise direction), at an angular position of 90 degrees (at a 3-o'clock position in the clockwise direction), at an angular position of 180 degrees (at a 6-o'clock position in the clockwise direction), and at an angular position of 270 degrees (at a 9-o'clock position in the clockwise direction), on the front surface of the nozzle box 1. The segment blocks 210 are spaced apart from each other by an angle of 90 degrees.

The front surface of each of the segment blocks 210 is located in the state in which the overall surface of the nozzle box 1 is closed in order to block movement of fluid introduced between the outer ring plate 100 and the inner ring plate 300. The rear surface of the segment block 210 is maintained in an opened state in order to move fluid introduced through the nozzle unit 200 disposed adjacent thereto. Here, the front surface of the segment block 210 corresponds to an inlet end 202 and the rear surface thereof corresponds to an outlet end 203.

The four segment blocks 210 which are circumferentially arranged may be installed at the inlet end 202 of the first-stage nozzle unit. More preferably, the segment blocks 210 are circumferentially arranged by an arc angle of 90 degrees so that the inlet end of the first-stage nozzle unit is divided into four portions.

As illustrated in the enlarged drawing, the front surface of each segment blocks 210 on a nozzle frame 204*a* is closed, but a streamlined nozzle 220*a* is formed at the center of a portion which extends rearward except the front surface of the segment block 210.

The segment blocks 210 are installed at the inlet end 202 of the first-stage nozzle unit, and the outlet end 203 of the first-stage nozzle unit is opened.

In addition, the segment block 210 has extension parts 205 which are formed so as to symmetrically extend outward from the nozzle 220*a* in order to be fixed to the outer ring plate 100 and the inner ring plate 300 at the left and right sides of the nozzle 220*a*, and an insertion hole 206 which is opened in each of the extension parts 205.

The extension parts 205 are formed with U-shaped coupling portions 207 so as to be more stably coupled to the outer ring plate 100 and the inner ring plate 300, and are thus coupled so as to come into close contact with the outer ring plate 100 and the inner ring plate 300. For reference, the outer ring plate 100 and the inner ring plate 300, which are latched to the coupling portions 207, have a shape corresponding thereto, and are thus coupled so as to come into close contact with each other.

A separate fixing piece (not shown) for fixing them is inserted into the insertion hole 206, and a pin may be, for example, used as the fixing piece.

When the ring-shaped nozzle box 1 is assumed to have a flat shape and is spread out in a range of 0 to 180 degrees, the segment blocks 210 are disposed by an angle of 90 degrees from 0 degrees. The nozzle 220*a* is arranged inside each of the segment blocks 210, and the nozzle box includes the nozzle unit 200 having a plurality of nozzles 220 which are adjacent to the nozzle 220*a* and are spaced at regular intervals.

The segment block 210 has a square block shape configured to have a closed front surface, but a fluid passage S1 or S2 is formed between the nozzle 220*a* of the segment block 210 and the nozzle 220 adjacent thereto in the nozzle unit 200 when viewed from the rear of the first-stage nozzle box 1.

The passage S1 or S2 extends so as to have an area reduced toward the trailing edge of the nozzle 220*a* from the leading edge thereof. Therefore, when a large amount of fluid moves toward the trailing edge related to the outlet end 203 from the inlet end 202, the velocity of fluid may be increased, which helps in forming a turbulent flow for movement of fluid.

The fluid may not be moved through the front surface of the segment block 210. However, the fluid may be stably moved in the rear corresponding to the outlet side of the nozzle box 1 by the fluid passage S1 or S2 between the nozzle 220*a* and the nozzle 220 adjacent thereto.

Figure 6:
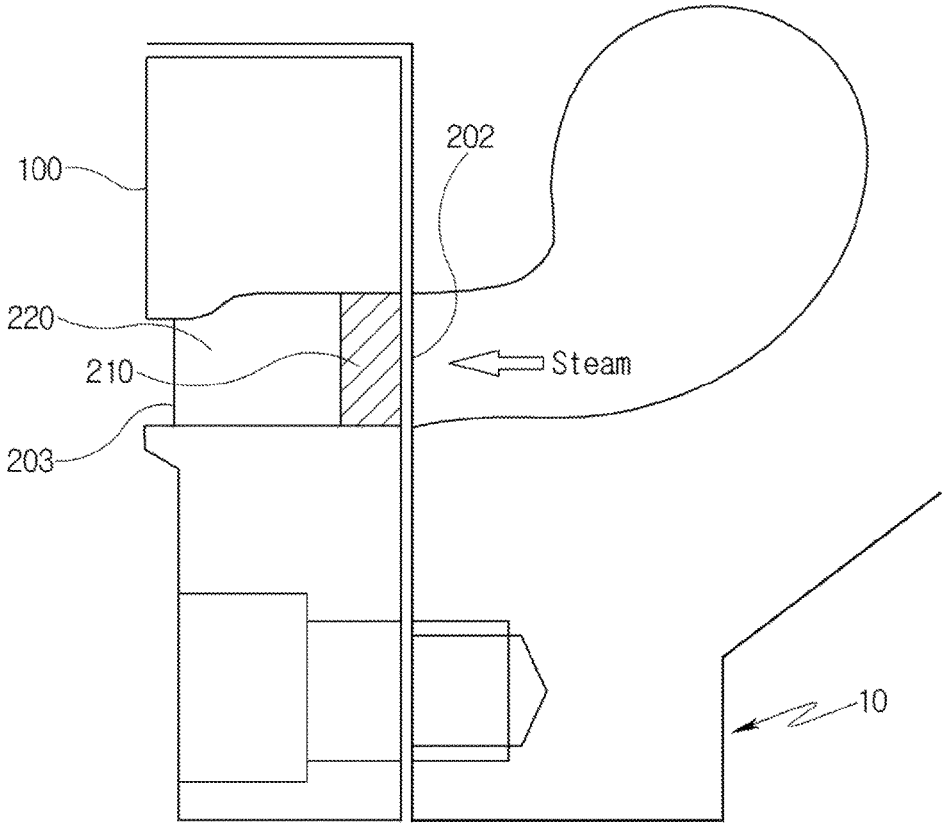
FIG. 6 is a longitudinal sectional view illustrating a portion where a certain segment block according to the embodiment of the present disclosure is located.

Accordingly, the movement of fluid may be easily controlled at the inlet end 202 (see FIG. 6) and outlet end 203 (see FIG. 6) of the nozzle box 1. Consequently, the flow efficiency of fluid at the outlet end 203 can be improved and thus the overall efficiency of the turbine can be improved.

For example, the segment blocks 210 are located at respective angular positions of 0 degrees, 90 degrees, 180 degrees, and 270 degrees, and the nozzle unit 200 is located between the segment blocks 210 spaced apart from each other. The nozzle unit 200 has the nozzles 220 which are spaced at regular intervals. Therefore, when steam is introduced in the arrow direction, it is moved from the inlet end 202 from the outlet end 203 through the nozzles 220.

Although not introduced into a closed portion of the inlet end 202 where each segment block 210 is located, fluid may be moved between the nozzle 220*a* in the segment block 210 and the nozzle 220 adjacent thereto in the nozzle unit 200 in the outlet end 203. Therefore, the fluid may be moved through all regions in the outlet end 203 of the nozzle box 1.

In each of the nozzles 220 disposed adjacent to the segment blocks 210, a nozzle frame 204 has the same shape as the above-mentioned nozzle frame 204*a* provided in each segment block 210, extension parts 205 are formed so as to symmetrically extend outward (to the left and right sides) in order to be fixed to the outer ring plate 100 and the inner ring plate 300 at the left and right sides of the nozzle 220, and an insertion hole 206 is opened in each of the extension parts 205.

The nozzle 220 has an opened shape such that fluid is introduced from the front surface of the nozzle box 1, and the nozzle 220 extends in a streamlined form toward the outlet end 203 of the nozzle box 1 corresponding to the rear. Consequently, the fluid may be stably moved.

The fluid may be stably moved in the outlet end 203 of the nozzle box 1 by the fluid passage S1 or S2 formed between the nozzle 220 and the nozzle 220*a* of the segment block 210.

A partial arc operation is performed in the nozzle box 1, and an operation supplies steam to only a partial region of the quadrant of the turbine. The partial arc operation may be performed for electricity generation capacity if necessary.

The present disclosure may increase the efficiency of the turbine during the partial arc operation. The four segment blocks 210 are installed at the inlet end of the nozzle unit 200 so as to be circumferentially arranged by an arc angle of 90 degrees so that the inlet end is divided into four portions for the partial arc operation, and the overall arc operation is performed in the outlet end of the nozzle unit in order to reduce the formation of a dead arc zone. Consequently, it is possible to improve the overall efficiency of the turbine.

Particularly, as described above, the nozzle unit 200 is disposed in the circumferential direction of the nozzle box 1 while being adjacent to the nozzle 220*a* provided in each segment block 210, and the nozzle unit 200 has the nozzles 220 spaced by a predetermined angle, with the consequence that high-pressure fluid may be stably moved.

Each of the nozzles 220 is formed so as to be circumferentially inclined at a predetermined angle, and the inside surface of the nozzle 220 has a streamlined shape. Thus, steam introduced into the inner casing is supplied to the rotors.

That is, high-temperature and high-pressure steam (vapor) may be guided so as to be uniformly moved by the nozzles 220, thereby improving the movement stability of the steam.

The nozzle 220 has an introduction portion 221 which is opened toward the front of the nozzle box 1 for introduction of steam, and the introduction portion 221 has a relatively larger opening area than a discharge portion 222. In addition, the discharge portion 222 for discharge of steam is relatively smaller than the introduction portion 221.

In this case, the velocity of high-temperature and high-pressure steam is accelerated and the pressure thereof is simultaneously increased while the steam is stably moved along the outer peripheral surface of each nozzle 220. Consequently, the steam is discharged to the rotors at high speed.

Accordingly, the steam, which is accelerated by the nozzles 220 provided in the nozzle unit 200, easily rotates the rotors.

Figure 7:
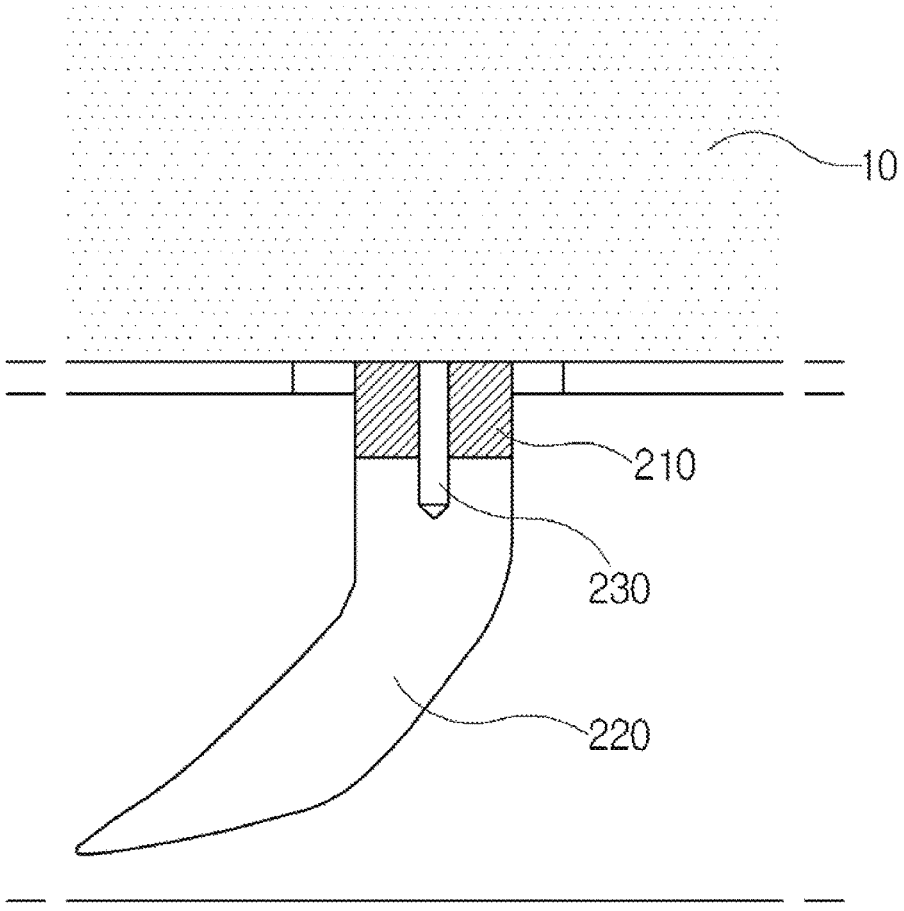
FIG. 7 is a transverse sectional view illustrating a portion where a certain segment block according to the embodiment of the present disclosure is located.

Referring to FIG. 7, according to another embodiment of the present disclosure, each segment block 210 and an associated one of nozzles 220 provided in a nozzle unit 200 may be coupled by a pin 230 in an inner casing. The pin 230 is inserted into the center of the nozzle 220 on the basis of the drawing, and thus the nozzle 220 is stably fixed by the pin 230.

As is apparent from the above description, a turbine nozzle box according to exemplary embodiments of the present disclosure can improve the overall efficiency of a turbine by circumferentially installing four segment blocks by an arc angle of 90 degrees at the inlet end of a nozzle unit so that the inlet end is divided into four portions for a partial arc operation, and by performing an overall arc operation in the outlet end of the nozzle unit so as to reduce the formation of a dead arc zone.

In the turbine nozzle box according to exemplary embodiments of the present disclosure, the segment blocks can be simply coupled to nozzles circumferentially installed by an arc angle of 90 degrees, and it is thus possible to reduce the time and cost for manufacturing the nozzles of the turbine.

While the present disclosure has been described with respect to the specific embodiments, it will be apparent to those skilled in the art that various changes and modifications may be made without departing from the spirit and scope of the invention as defined in the following claims.

It will be apparent to those skilled in the art that various changes and modifications may be made without departing from the spirit and scope of the embodiments as defined in the following claims.

The embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, the claims should not be limited by the language chosen under a heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A turbine nozzle box, comprising:

an annular outer ring plate operable to be disposed in a turbine such that an outer peripheral surface thereof is adjacent to an inner peripheral surface of an inner casing of the turbine;

an annular nozzle unit disposed adjacent to an inner peripheral surface of the annular outer ring plate; and an annular inner ring plate disposed such that an outer peripheral surface thereof is adjacent to an inner peripheral surface of the nozzle unit, wherein the nozzle unit includes a plurality of segment blocks circumferentially installed at an arc angle, wherein each of the plurality of segment blocks includes:

a nozzle frame configured to close a gap between the annular outer ring plate and the annular inner ring plate on a front surface of the nozzle box, a nozzle located at an inner portion of the nozzle frame while extending toward the outlet end of the nozzle box, extension parts extending outward from the nozzle, the extension parts being engaged with the annular outer ring plate and the annular inner ring plate, a plurality of nozzles including extension parts that are engaged with the annular outer ring plate and the annular inner ring plate, and an introduction portion disposed between the extension parts and a discharge portion, wherein the plurality of segment blocks is disposed at an inlet end of a first-stage nozzle unit and the plurality of segment blocks is disposed between the plurality of nozzles, and wherein an outlet end of the first-stage nozzle unit is open.

2. The turbine nozzle box according to claim 1, wherein each of the annular outer ring plate, the nozzle unit, and the annular inner ring plate are divided into two upper and lower portions, each having a semicircular shape.

3. The turbine nozzle box according to claim 1, wherein the plurality of segment blocks include four segment blocks circumferentially disposed at the inlet end of the first-stage nozzle unit.

4. The turbine nozzle box according to claim 3, wherein the plurality of segment blocks are circumferentially arranged by an arc angle of 90 degrees so that the inlet end of the first-stage nozzle unit is divided into four portions.

5. The turbine nozzle box according to claim 1, wherein each of the plurality of segment blocks further includes an insertion hole defined in each of the extension parts.

6. The turbine nozzle box according to claim 5, wherein the extension parts include coupling portions, and corresponding surfaces of the annular outer and inner ring plates facing the respective coupling portions have a shape corresponding to the coupling portions.

7. The turbine nozzle box according to claim 5, wherein a passage is provided such that fluid is outwardly movable from the nozzle formed in the segment block.

8. The turbine nozzle box according to claim 7, wherein the passage is narrowed from a leading edge toward a trailing edge of the nozzle.

9. The turbine nozzle box according to claim 1, wherein the nozzle unit is configured such that an introduction portion formed on a front surface of each of the nozzles has a relatively larger area than a discharge portion formed on a rear surface thereof.

10. The turbine nozzle box according to claim 1, wherein each of the plurality of segment blocks is formed integrally with an associated one of nozzles arranged by an arc angle of 90 degrees in the outlet end of the first-stage nozzle unit.

11. The turbine nozzle box according to claim 1, wherein each of the plurality of segment blocks and an associated one of nozzles arranged by an arc angle of 90 degrees in the outlet end of the first-stage nozzle unit are coupled to each other by a pin in the inner casing.

* * * * *